US009360192B2

(12) United States Patent
Ming et al.

(10) Patent No.: US 9,360,192 B2
(45) Date of Patent: Jun. 7, 2016

(54) LED ILLUMINATING DEVICE

(71) Applicant: Osram GmbH, Munich (DE)

(72) Inventors: Yusheng Ming, Shenzhen Guangdong (CN); Peng Chen, Shenzhen Guangdong (CN); Haiping Yuan, Shenzhen Guangdong (CN); Hui Gui, Shenzhen Gangdong (CN)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 14/358,226

(22) PCT Filed: Nov. 15, 2012

(86) PCT No.: PCT/EP2012/072770
§ 371 (c)(1),
(2) Date: May 15, 2014

(87) PCT Pub. No.: WO2013/072429
PCT Pub. Date: May 23, 2013

(65) Prior Publication Data

US 2014/0313740 A1 Oct. 23, 2014

(30) Foreign Application Priority Data

Nov. 17, 2011 (CN) ..... 2011 1 0366671

(51) Int. Cl.

| | |
|---|---|
| ***F21V 13/04*** | (2006.01) |
| ***F21K 99/00*** | (2016.01) |
| ***B61L 5/18*** | (2006.01) |
| *F21Y 101/02* | (2006.01) |

(52) U.S. Cl.
CPC ..... *F21V 13/04* (2013.01); *B61L 5/1845* (2013.01); *B61L 5/1854* (2013.01); *F21K 9/50* (2013.01); *F21K 9/54* (2013.01); *B61L 2207/02* (2013.01); *F21Y 2101/02* (2013.01)

(58) Field of Classification Search
CPC ..... F21V 13/04; F21Y 2101/02
USPC ..... 362/308
See application file for complete search history.

(56) References Cited

U.S. PATENT DOCUMENTS 8,240,875 B2 * 8/2012 Roberts et al. ..... 362/217.05
8,894,251 B2 * 11/2014 Yokotani et al. ..... 362/311.02

(Continued)

FOREIGN PATENT DOCUMENTS

| | | | |
|---|---|---|---|
| CN | 101082404 | A | 12/2007 |
| CN | 201680227 | U | 12/2010 |
| WO | 2006016324 | A1 | 2/2006 |

OTHER PUBLICATIONS

International Search Report issued in the corresponding PCT application No. PCT/EP2012/072770, dated Feb. 4, 2013.

(Continued)

*Primary Examiner* — Anabel Ton
(74) *Attorney, Agent, or Firm* — Viering, Jentschura & Partner mbH

(57) ABSTRACT

An LED illuminating device includes a printed circuit board, at least one LED chip group arranged on the printed circuit board, and a lens assembly, wherein the LED illuminating device further includes a reflector provided between the LED chip group and the lens assembly, wherein the reflector is configured to diffusely reflect light from the LED chip group so that the light is uniformized and emerges in a direction of the lens assembly.

10 Claims, 7 Drawing Sheets

(56) References Cited

U.S. PATENT DOCUMENTS

| | | | | |
|---|---|---|---|---|
| 2007/0274070 | A1 | 11/2007 | Wedell | |
| 2011/0141725 | A1 | 6/2011 | Brusilovsky | |
| 2013/0114022 | A1 * | 5/2013 | Iiyama et al. | 349/64 |

OTHER PUBLICATIONS

Chinese Office Action based on Application No. 201110366671.6(6 Pages and 6 pages of English translation) dated Nov. 12, 2015.

* cited by examiner

LED ILLUMINATING DEVICE

RELATED APPLICATIONS

The present application is a national stage entry according to 35 U.S.C. §371 of PCT application No.: PCT/EP2012/072770 filed on Nov. 15, 2012, which claims priority from Chinese application No.: 201110366671.6 filed on Nov. 17, 2011, and is incorporated herein by reference in its entirety.

TECHNICAL FIELD

Various embodiments relate to an LED illuminating device, particularly used in traffic, especially used in railway traffic as a railway signal light.

BACKGROUND

A railway signal light is used in a field environment. A train driver must be able to clearly see light emitted from the signal light at a reasonable distance in various weather conditions. Thus, the signal light must be designed to meet related national requirements. Corresponding standards of the railway signal light are established in China, wherein a horizontal beam angle of light generated by the signal light should be between −2.2° and 6°, a vertical beam angle should be between −1.02° and 6°, and a light spot generated thereby should be uniform.

The current railway signal lights mostly use a halogen lamp as a light source, while it has a high power, and will waste a lot of energies in a long time use. In addition, there is only one halogen lamp as the light source, then, if the halogen lamp is damaged and is not timely changed, the signal light will stop working, so the operation reliability is relatively poor. A signal light taking an LED as a light source is also available in the current market, and the light source of such signal light usually consists of a plurality of LEDs. As there is inevitably a certain spatial distance between the LEDs, light emitted from respective LED of the light source will generate a light point which cannot be well eliminated with a lens of a traditional signal light for obtaining a uniform light spot. However, such light points make it quite difficult for secondary optical design of the signal light.

SUMMARY

In order to solve the above problems, various embodiments provide an LED illuminating device which is used particularly in traffic, especially in railway traffic as a railway signal light. The LED illuminating device of the present disclosure, when used as a signal light, is able to generate a uniform light spot and well satisfy related industry provisions.

Various embodiments provide an LED illuminating device. The LED illuminating device includes a printed circuit board, and at least one LED chip group arranged on the printed circuit board and a lens assembly. In addition, the LED illuminating device further includes a reflector provided between the LED chip group and the lens assembly for diffusely reflecting light from the LED chip group so that the light is uniformized and emerges in a direction of the lens assembly. In one solution of the present disclosure, light from respective LED chips of the LED chip group firstly is diffusely reflected by the reflector so as to eliminate light points formed by light from respective LED chips and to make output light more uniform, thereby the LED chip group is enabled to generate a uniform light spot.

Preferably, the reflector is a plate-shaped body with a via, wherein the via is formed with an accommodation opening for the LED chip group at one side thereof facing the printed circuit board, and formed with a light emergent opening at the other side opposite to the one side, wherein an inner wall of the via forms a diffuse reflective region that can effectively diffusely reflect light from respective LED chips so as to eliminate the light points.

Further preferably, the via has a dimension gradually reduced from the accommodation opening to the light emergent opening. Since the LED chip group is directly placed in the accommodation opening, light from the LED chip group will not directly emerge from the light emergent opening as it is blocked by the diffuse reflective region, which therefore effectively prevents formation of the light points.

Optionally, the light emergent opening is circular for forming a circular light spot.

In various embodiments, the LED chip group includes a primary LED chip group and a redundant LED chip group, wherein the primary LED chip group and the redundant LED chip group consist of two LED chips, respectively, the four LED chips are arranged in a square on the printed circuit board, and the LED chips in the same group are arranged at same diagonal of the square. In order to try to make the light points formed by light from respective LED chips to be not easily identified, the LED chips are arranged as closely to each other as is possible. Two LED chip groups are used in one solution of the present disclosure because a redundant LED chip group can greatly improve the safety coefficient of the whole LED illuminating device since the LED illuminating device as a signal light is usually used in a field environment, the operation condition is bad, and the railway traffic might be adversely affected if the LED chip as a light source is failed.

Preferably, the accommodation opening is a square opening that has a dimension bigger than or equal to a dimension of the LED chip group. As the LED chips are just against the square opening, it further prevents light from the LED chips from directly emerging from the light emergent opening.

In various embodiments, a projection is provided at the other side of the reflector away from the printed circuit board, and the light emergent opening is opened on the projection. A distance between the light emergent opening and the accommodation opening is increased by forming the projection, thus an area of the diffuse reflective region is prominently increased, and light from the LED chips can be diffusely reflected more sufficiently.

In various embodiments, the LED illuminating device further includes an attachment lens provided between the reflector and the lens assembly. The attachment lens further uniformizes light diffusely reflected by the reflector so as to eliminate the light points.

Preferably, the attachment lens has a microlens array including a plurality of microlenses which are in a honeycomb arrangement, wherein respective microlens in the microlens array is a spherical lens.

Advantageously, the lens assembly consists of a first Fresnel lens and a second Fresnel lens arranged in sequential in a light emerging direction. The lens assembly formed jointly by the two Fresnel lenses results in an effect of a convex, serving a function of focusing light diffusely reflected by the reflector so as to render a stronger directivity of light from the LED illuminating device.

Preferably, the reflector is made from a PC material, and of course, the reflector also can be made from other materials that can perform a diffuse reflection.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
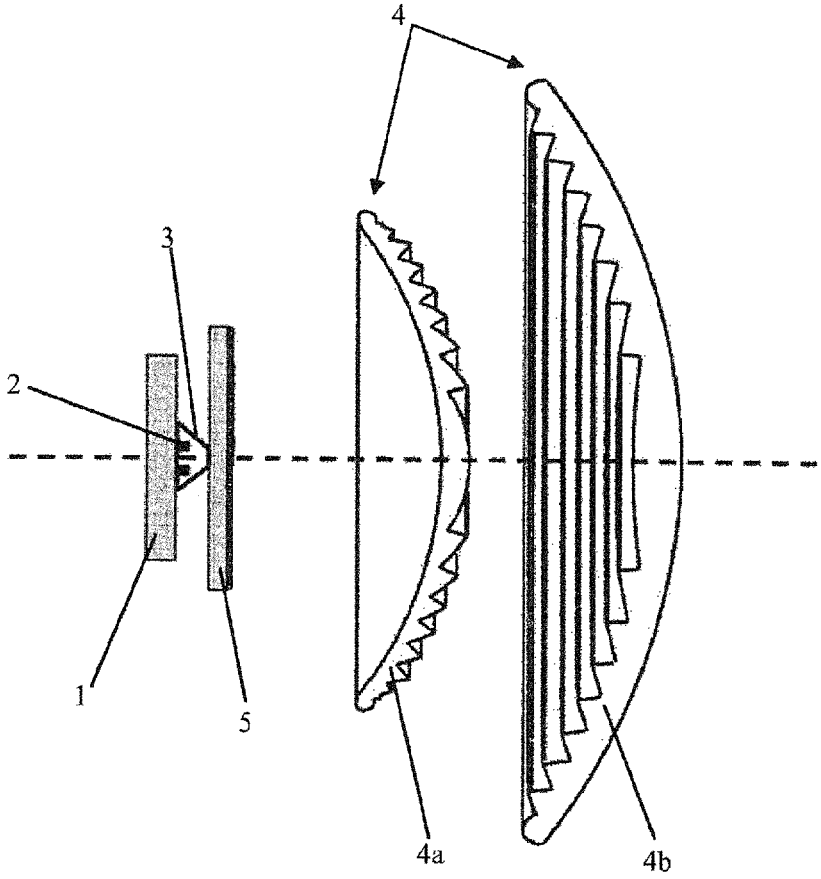
FIG. 1 is an exploded schematic diagram of an LED illuminating device of the present disclosure.

FIG. 1 is an exploded schematic diagram of an LED illuminating device of the present disclosure. It can be seen from FIG. 1 that the LED illuminating device of the present disclosure comprises a printed circuit board 1, and at least one LED chip group 2 arranged on the printed circuit board 1 and a lens assembly 4. Besides, the LED illuminating device further comprises reflector 3 provided between the LED chip group 2 and the lens assembly 4 for diffusely reflecting light from the LED chip group 2 so that the light is uniformized and emerges in a direction of the lens assembly 4. In one solution of the present disclosure, the lens assembly 4 consists of a first Fresnel lens 4*a* and a second Fresnel lens 4*b* arranged in sequential in a light emerging direction. The lens assembly 4 formed jointly by the two Fresnel lenses 4*a*, 4*b* results in an effect of a convex, serving a function of focusing light diffusely reflected by the reflector 3 so as to render a stronger directivity of light from the LED illuminating device. Besides, an attachment lens 5 is further provided between the reflector 3 and the lens assembly 4.

Figure 2:
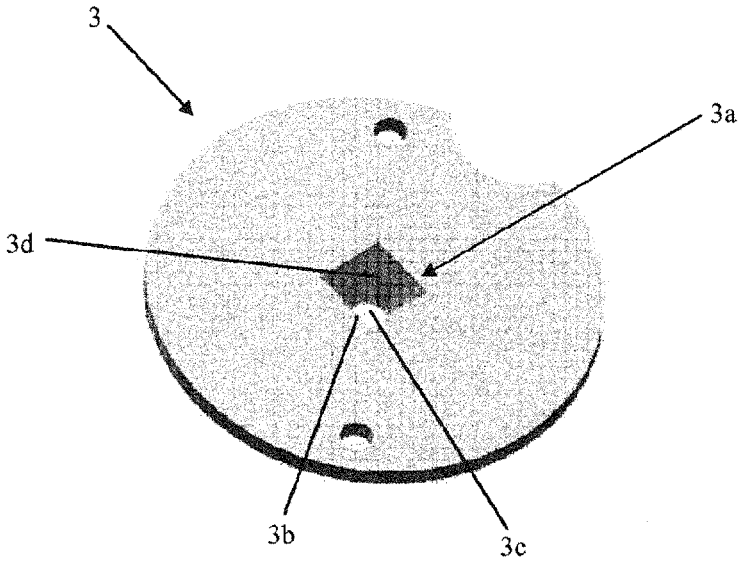
FIG. 2 is a schematic diagram of one side of a reflector of an LED illuminating device of the present disclosure.
Figure 3:
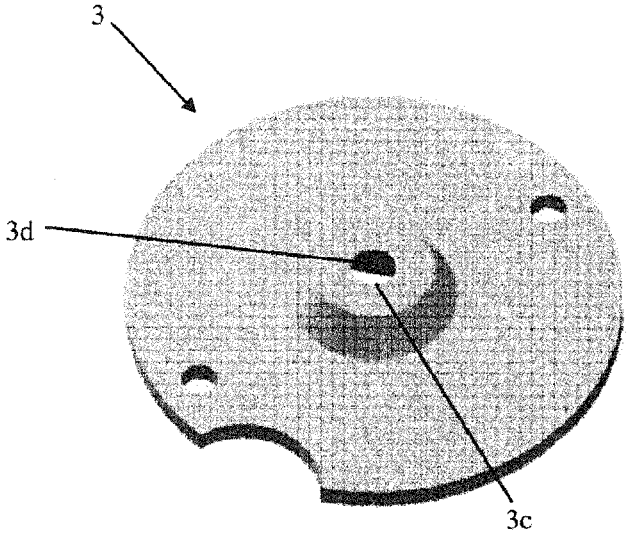
FIG. 3 is a schematic diagram of the other side of the reflector of the LED illuminating device of the present disclosure.

FIG. 2 and FIG. 3 are schematic diagrams of two sides of the reflector 3 of the LED illuminating device of the present disclosure, respectively. As can be seen from FIG. 2 and FIG. 3, the reflector 3 is a plate-shaped body with a via 3*a*, wherein the via 3*a* is formed with an accommodation opening 3*b* for the LED chip group 2 at one side thereof facing the printed circuit board 1 (see FIG. 2) and formed with a light emergent opening 3*c* at the other side opposite to the one side (see FIG. 3), wherein an inner wall of the via 3*a* forms a diffuse reflective region 3*d*. In addition, it can be seen from FIG. 2 that the via 3*a* has a dimension gradually reduced from the accommodation opening 3*b* to the light emergent opening 3*c*. In one solution of the present disclosure, the reflector 3 is made from a PC material, and of course, it also can be made from other types of diffusing materials.

It can be seen from FIG. 3 that a projection is provided at the other side of the reflector 3 away from the printed circuit board 1, and the light emergent opening 3*c* is opened on the projection. An incident surface of the attachment lens 5 is directly against the projection when the LED illuminating device of the present disclosure is assembled.

In addition, it can be seen from FIG. 2 and FIG. 3 that the light emergent opening 3*c* is circular, which is quite favorable for forming a circular light spot. Besides, the accommodation opening 3*b* is a square opening.

Figure 4:
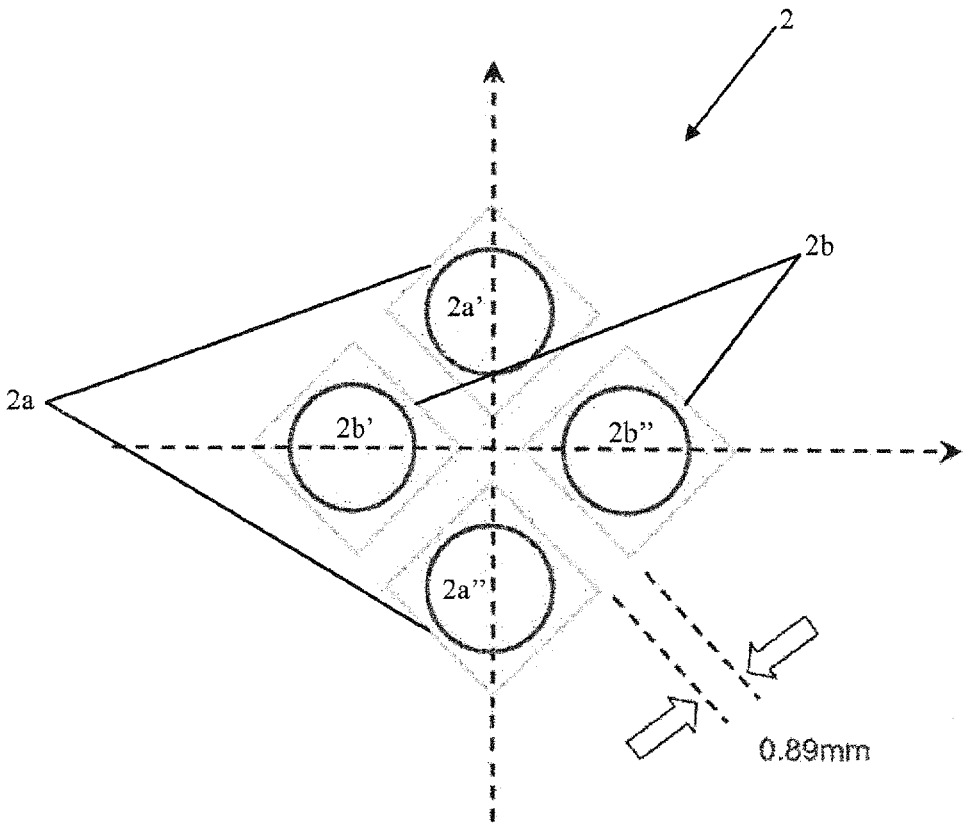
FIG. 4 is a schematic diagram of an LED chip group of an LED illuminating device of the present disclosure.

FIG. 4 is a schematic diagram of the LED chip group 2 of the LED illuminating device of the present disclosure. According to the present disclosure, the LED chip group 2 comprises a primary LED chip group 2*a* and a redundant LED chip group 2*b*, wherein the primary LED chip group 2*a* consists of two LED chips 2*a*', 2*a*" and the redundant LED chip group 2*b* consists of two LED chips 2*b*', 2*b*", the LED chips 2*a*', 2*a*" and 2*b*', 2*b*" are arranged in a square on the printed circuit board 1, and the LED chips 2*a*', 2*a*" and 2*b*', 2*b*" in the same group are arranged at two ends of the same diagonal of the square. The LED chips 2*a*', 2*a*" and 2*b*', 2*b*" are arranged to be directly as closely to each other as is possible. OSLON LED chips of OSRAM are used in one solution of the present disclosure, by which a distance between edges of adjacent chips is 0.89 mm. Of course, other types of LED chips also can be used. The adjacent chips should be arranged to be close if the processing condition allows.

In addition, in order to try to prevent light from directly emerging from the light emergent opening 3*c*, the square accommodation opening 3*b* is a square opening that has a dimension bigger than or equal to that of the LED chip group 2.

Figure 6:
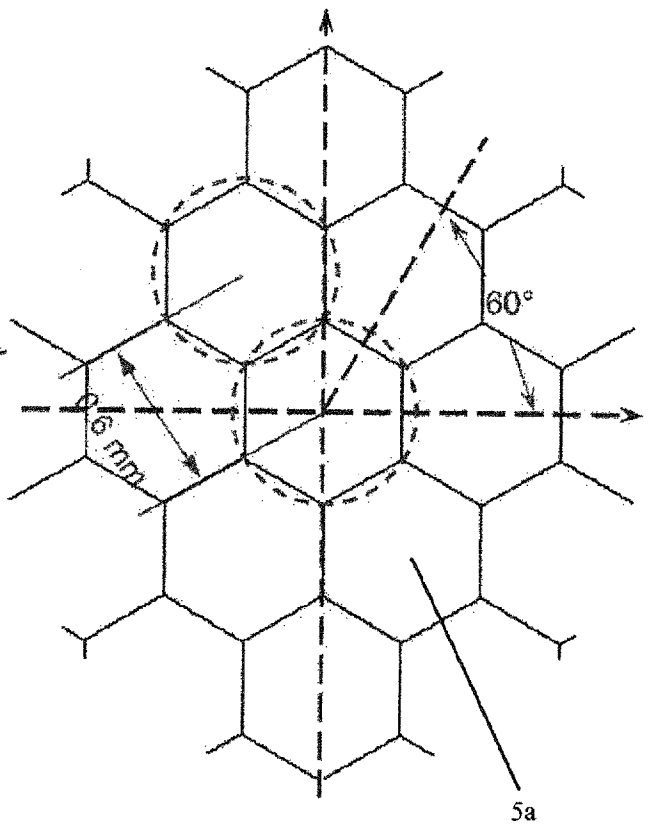
FIG. 6 is a local enlarged view of an attachment lens.
Figure 5:
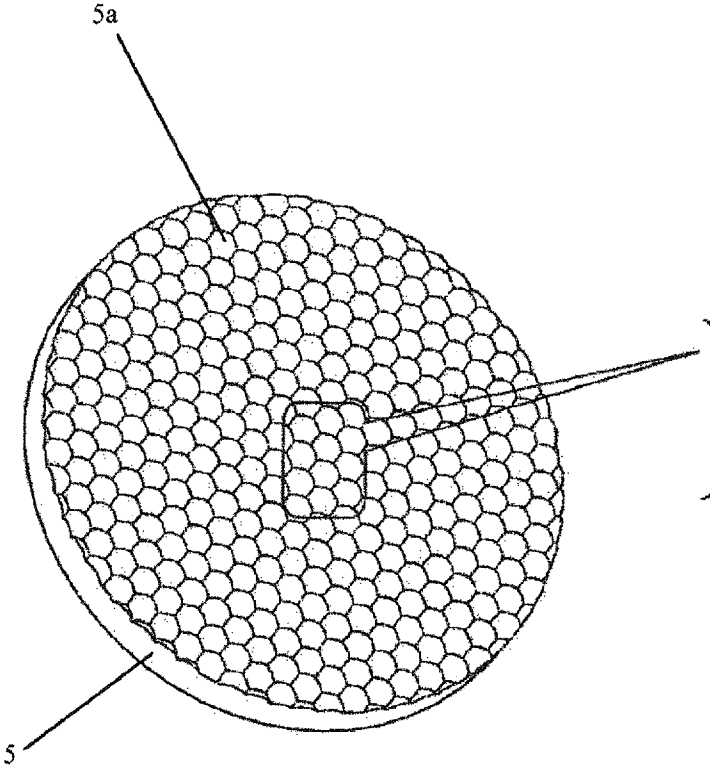
FIG. 5 is a schematic diagram of an attachment lens of an LED illuminating device of the present disclosure.
Figure 7:
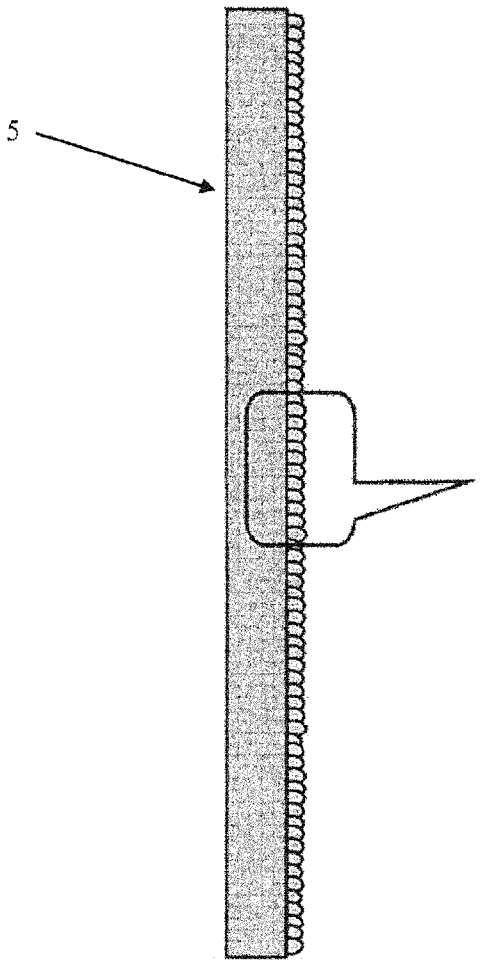
FIG. 7 is a sectional view of an attachment lens.
Figure 8:
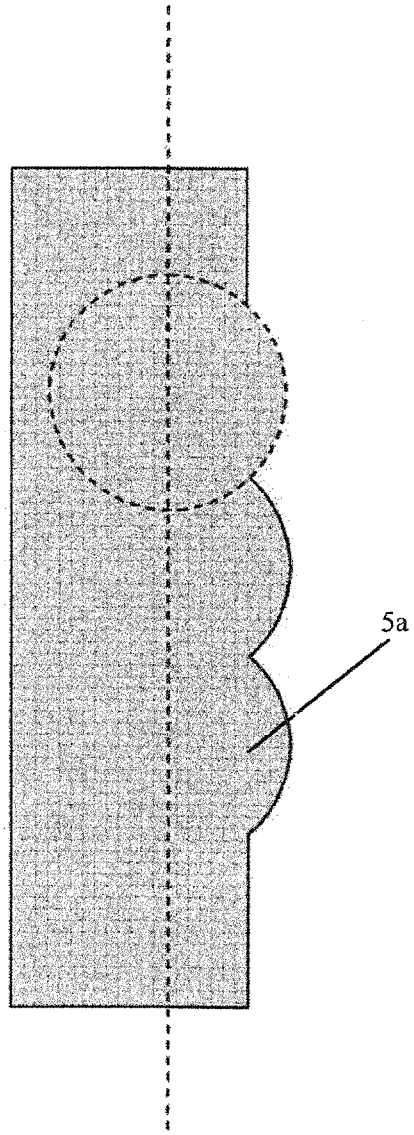
FIG. 8 is a local enlarged view of the sectional view shown in FIG. 7.

Further, FIG. 5-FIG. 8 specifically show schematic diagrams of the attachment lens 5. As can be seen from FIG. 5, the attachment lens 5 has a microlens array including a plurality of microlenses 5*a* which are in a honeycomb arrangement, wherein FIG. 6 is a local enlarged view of the microlens array, from which it can be seen that respective microlens 5*a* has an outline of a regular hexagon, wherein a distance between two opposite sides is 0.6 mm, and of course, a dimension of the regular hexagon also can be correspondingly adjusted according to requirements. FIG. 7 is a sectional view of the attachment lens 5, and FIG. 8 is a local enlarged view of the sectional view shown in FIG. 7. It can be seen from FIG. 8 that respective microlens 5*a* in the microlens array is a spherical lens.

Figure 9:
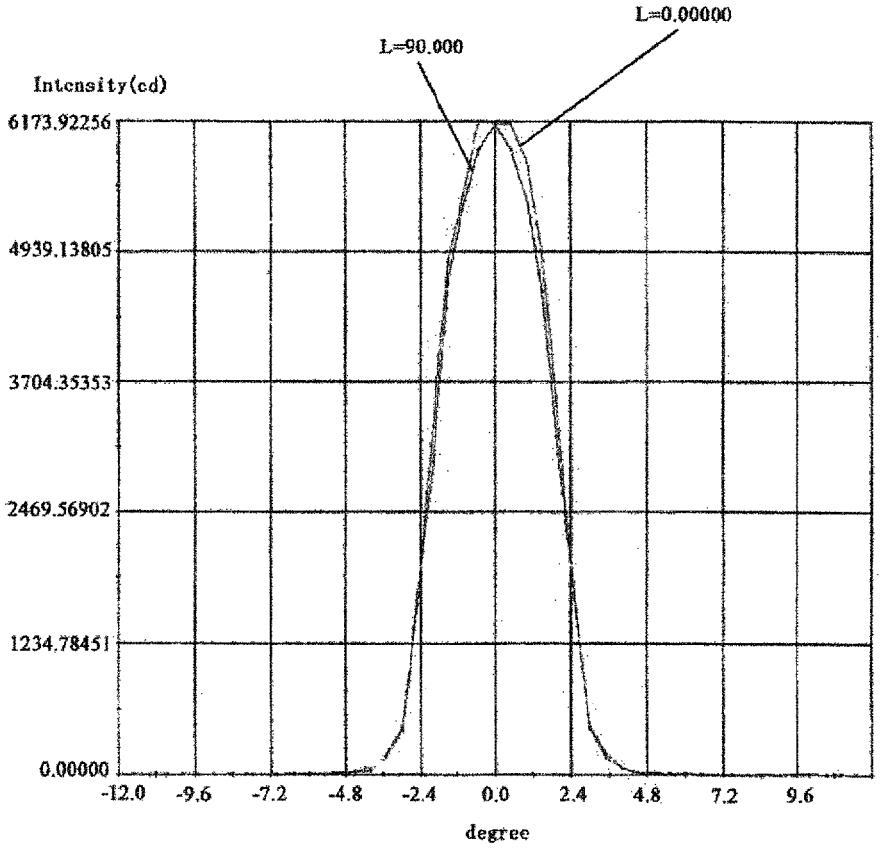
FIG. 9 is a diagram of light intensity distribution of light generated by an LED illuminating device of the present disclosure.

FIG. 9 is a diagram of light intensity distribution of light generated by the LED illuminating device of the present disclosure. As can be seen from FIG. 9, a light spot generated by the LED illuminating device of the present disclosure is quite uniform within an angle range between −4.5° and 4.5°.

Figure 10:
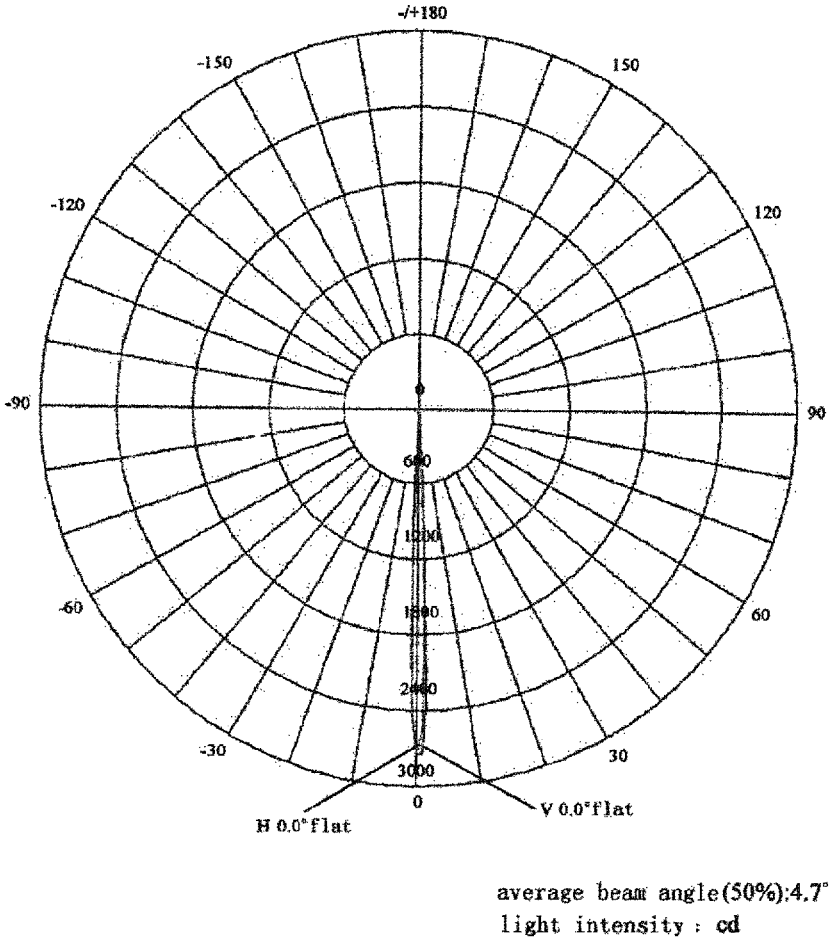
FIG. 10 is a diagram of angle distribution of light generated by an LED illuminating device of the present disclosure.

FIG. 10 is a diagram of angle distribution of light generated by the LED illuminating device of the present disclosure. It can be seen from FIG. 10 that the light spot generated by the LED illuminating device of the present disclosure has a good directivity, and a horizontal beam angle and a vertical beam angle thereof are both in a reasonable range, satisfying related provisions in the industry.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

1 printed circuit board
2 LED chip group
2*a* primary LED chip group
2*b* redundant LED chip group
2*a*', 2*a*"; 2*b*, 2*b*" LED chip
3 reflector
3*a* via
3*b* accommodation opening
3*c* light emergent opening
3*d* diffuse reflective region
4 lens assembly
4*a* first Fresnel lens
4*b* second Fresnel lens
5 attachment lens
5*a* microlens

The invention claimed is:

1. An LED illuminating device, comprising:
a printed circuit board,
at least one LED chip group arranged on the printed circuit board, and
a lens assembly,
wherein the LED illuminating device further comprises a reflector provided between the LED chip group and the lens assembly, wherein the reflector is configured to diffusely reflect light from the LED chip group so that the light is uniformized and emerges in a direction of the lens assembly,
wherein the reflector is a plate-shaped body with a via, wherein the via is formed with an accommodation opening for the LED chip group at one side thereof facing the printed circuit board, and formed with a light emergent opening at the other side opposite to the one side, wherein an inner wall of the via forms a diffuse reflective region.

2. The LED illuminating device according to claim 1, wherein the via has a dimension gradually reduced from the accommodation opening to the light emergent opening.

3. The LED illuminating device according to claim 2, wherein the light emergent opening is circular.

4. The LED illuminating device according to claim 2, wherein the LED chip group comprises a primary LED chip group and a redundant LED chip group, wherein the primary LED chip group and the redundant LED chip group comprise two LED chips, respectively, the LED chips are arranged in a square on the printed circuit board, and the LED chips in the same group are arranged at diagonal of the square.

5. The LED illuminating device according to claim 4, wherein the accommodation opening is a square opening that has a dimension bigger than or equal to a dimension of the LED chip group.

6. The LED illuminating device according to claim 1, wherein a projection is provided at the other side of the reflector away from the printed circuit board, and the light emergent opening is opened on the projection.

7. An LED illuminating device, comprising:
a printed circuit board,
at least one LED chip group arranged on the printed circuit board, and
a lens assembly,
wherein the LED illuminating device further comprises a reflector provided between the LED chip group and the lens assembly, wherein the reflector is configured to diffusely reflect light from the LED chip group so that the light is uniformized and emerges in a direction of the lens assembly,
wherein the LED illuminating device further comprises an attachment lens provided between the reflector and the lens assembly.

8. The LED illuminating device according to claim 7, wherein the attachment lens has a microlens array including a plurality of microlenses which are in a honeycomb arrangement, wherein respective microlens is a spherical lens.

9. The LED illuminating device according to claim 1, wherein the lens assembly comprises a first Fresnel lens and a second Fresnel lens arranged in sequential in a light emerging direction.

10. The LED illuminating device according to claim 1, wherein the reflector is made from a PC material.

* * * * *